US010553350B2

(12) United States Patent
Akimoto

(10) Patent No.: US 10,553,350 B2
(45) Date of Patent: Feb. 4, 2020

(54) IGNITION COIL FOR AN INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 53 days.

(21) Appl. No.: 15/509,626

(22) PCT Filed: Sep. 8, 2015

(86) PCT No.: PCT/JP2015/075403
§ 371 (c)(1),
(2) Date: Mar. 8, 2017

(87) PCT Pub. No.: WO2016/039311
PCT Pub. Date: Mar. 17, 2016

(65) Prior Publication Data

US 2017/0263375 A1 Sep. 14, 2017

(30) Foreign Application Priority Data

Sep. 8, 2014 (JP) ..... 2014-182540

(51) Int. Cl.
*H01F 38/12* (2006.01)
*F02P 15/00* (2006.01)
(Continued)

(52) U.S. Cl.
CPC ..... *H01F 38/12* (2013.01); *F02P 15/00* (2013.01); *H01F 27/02* (2013.01); *H01F 27/022* (2013.01); *F02P 3/02* (2013.01)

(58) Field of Classification Search
CPC ..... H01F 38/12; H01F 27/02; H01F 27/022; H02P 15/00; H02P 3/02
(Continued)

(56) References Cited

U.S. PATENT DOCUMENTS 4,928,660 A * 5/1990 Sohner ..... F02P 3/08 123/635
5,044,328 A * 9/1991 Umezaki ..... F02P 3/02 123/640
(Continued)

FOREIGN PATENT DOCUMENTS

EP 0 738 831 A2 10/1996
JP 2006-210374 8/2006
(Continued)

*Primary Examiner* — Mang Tin Bik Lian
(74) *Attorney, Agent, or Firm* — Nixon & Vanderhye PC

(57) ABSTRACT

An ignition coil is provided with a primary coil, a secondary coil, a center core, and an outer core. The primary coil, secondary coil, the center core, and the outer core are accommodated inside a case, the inside of the case is filled with a resin filler having electrical insulating properties. The case has an opening member which opens to an upper-side of a vertical direction, a side wall section formed by the opening member, and a bottom member covering a lower-side of the side wall section. A circular cover member, formed on the opening member, provided with a through opening which passes through the inner-side of the opening member in the vertical direction.

14 Claims, 4 Drawing Sheets

(51) Int. Cl.
*H01F 27/02* (2006.01)
*F02P 3/02* (2006.01)

(58) Field of Classification Search
USPC ..... 336/90, 96; 123/634, 635
See application file for complete search history.

(56) References Cited

U.S. PATENT DOCUMENTS

| | | | | |
|---|---|---|---|---|
| 6,894,597 | B2 * | 5/2005 | Skinner | H01F 27/022<br>123/635 |
| 8,564,392 | B1 * | 10/2013 | Skinner | H01F 27/02<br>123/634 |
| 2003/0034865 | A1 * | 2/2003 | Moga | H01F 27/362<br>336/90 |
| 2003/0058077 | A1 * | 3/2003 | Hamer | H01F 27/327<br>336/198 |
| 2005/0212635 | A1 * | 9/2005 | Klocinski | H01F 27/266<br>336/90 |
| 2014/0345582 | A1 | 11/2014 | Yamauchi et al. | |

FOREIGN PATENT DOCUMENTS

| | | |
|---|---|---|
| JP | 2007-194364 | 8/2007 |
| JP | 2007-227411 | 9/2007 |
| JP | 2007-250642 | 9/2007 |
| JP | 2007-299919 | 11/2007 |
| JP | 2008-60228 | 3/2008 |
| JP | 2011-003812 | 1/2011 |
| WO | WO 2012/121177 A1 * | 9/2012 |

* cited by examiner

IGNITION COIL FOR AN INTERNAL COMBUSTION ENGINE

This application is the U.S. national phase of International Application No. PCT/JP2015/075403 filed Sep. 8, 2015 which designated the U.S. and claims priority to Japanese Patent Application No. 2014-182540 filed Sep. 8 2014, the entire contents of each of which are hereby incorporated by reference.

TECHNICAL FIELD

The present disclosure relates to an ignition coil for an internal combustion engine.

BACKGROUND ART

An ignition coil for an engine, such as, an internal combustion engine, is equipped with, for example, a primary coil and a secondary coil arranged concentrically stacked on an inner periphery and outer periphery, a center core arranged at an axial centered position of the primary coil and the secondary coil, and an outer core positioned on an outer peripheral-side of the primary coil and the secondary coil (patent literature 1). Each of the configuring elements are accommodated inside a case. A resin filler made of a thermosetting resin, for example, epoxy resin fills in gaps formed inside the case. The resin filler is used to fill the gaps inside the case and insulate the configuring elements.

At a manufacturing stage of the ignition coil, after the configuring elements, for example, the primary coil, the secondary coil, center core and the outer core are mounted inside the case, and a fluid resin filler, poured inside the case from an opening port of thereof, is solidified.

CITATION LIST

Patent Literature

[Patent Literature 1] JP-A No. 2007-194364.

TECHNICAL PROBLEM

However the ignition coil disclosed in the Japanese patent literature 1 has several problems. Specifically, when manufacturing the ignition coil according to the patent literature 1, after filling a fluid resin into a case, in order to solidify the fluid resin the case is subjected to a heating process. At this point, if an external force, for example a vibration is applied to the ignition coil, surge waves occur on a fluid surface of the fluid resin, and leakage of the resin filler from inside the case may occur, resulting in faulty conditions, for example, poor appearance and poor insulation. For reasons above, it is necessary to carefully manage a filling quantity of a resin filler, a speed during a moving process and a moving process means which results in a decrease in the production efficiency.

Furthermore, in order to prevent resin filler from leakage, increasing a height of the case, in relation to a fluid surface of the resin filler is considered, however, this in turn leads to an increase in size of the ignition coil and indeed manufacturing cost, which is undesirable.

SUMMARY OF INVENTION

In view of the foregoing, the present disclosure aims to provide an ignition coil in which, leakage of a resin filler before solidification is suppressed, and improved productivity and miniaturization of the ignition coil is achieved.

Solution to Problem

A mode of the present disclosure is an ignition coil for an internal combustion engine, provided with a primary coil formed by a primary winding, a secondary coil formed by a secondary winding that is positioned on an outer peripheral side of the primary winding, a center core inserted at an inner-side of the primary coil and secondary coil, an outer core positioned at an outer-side of the primary coil and the secondary coil, and a case to accommodate the primary coil, the secondary coil, the center core and the outer core. An inside of the case having resin filler provided with electrical insulating properties. The case also has an opening member, opened to an up-side of a vertical direction, and a side-wall member surrounding the center core and the outer core which also forms the opening member. The side-wall member is also provided with a bottom member covering a lower-side of the side-wall member. The opening member is projected from an inner-side of the opening member towards an inner-side of the cover. The opening member also has a circular cover member provided with a through opening which passes through the inner-side of the opening member in the vertical direction.

Effect of Invention

In providing the ignition coil with the cover member, an opening area of the opening of the case is decreased, and an exposed area of a fluid surface, being a fluid surface of the resin filler before solidification, is also decreased. As a result, leakage of the fluid resin can be suppressed in the ignition coil.

That is, if the exposed surface of the fluid surface of the resin filler is large, wave height easily increases when surge waves are formed on the liquid surface, by an external force such as a vibration, and the resin filler easily leaks. In providing the ignition coil with the cover member, the opening area of the through opening, which is smaller than the opening member of the case, is the exposed area of the fluid surface of the resin filler. As a result, the wave height of the fluid surface can be decreased. The ignition coil, provided with the cover member surrounding a periphery of the fluid surface of the resin filler, and the side wall member of the case set to a minimum height, can thus suppress leakage of the fluid resin from the case.

Furthermore, by providing the cover member, a distance between an outer periphery of the case and the through opening is increased. As a result, even if the resin filler leaks from the through opening, the resin filler is accumulated in an upper surface of the cover member. The ignition coil can also prevent an adhesion of foreign substances, due to the resin filler leakage to an outer side of the ignition coil. At a point of installing the ignition coil in an internal combustion engine, occurrence of defects can thus be prevented.

As described above, by employing a configuration which can suppress leakage of the resin filler, management of a filling quantity of the resin filler, at a point of filling, and each process, for example, from filling the resin filler to transfer during a solidification, can be smoothly performed and productivity of the ignition coil can be increased.

According to the ignition coil described above, leakage of the resin filler before solidification is suppressed, productivity increased and miniaturization can be achieved.

Various working effects of other configuration examples in the present disclosure, described below are obtained.

At least a section of a bottom surface of the cover member is preferably formed as an oblique surface, which is oblique toward a lower part, from an inner-side toward an outer side of the cover member. When filling the case with the resin filler, at a part that is lower than the cover member 2, referred to as a lower part, air bubbles inside the resin filler float upwards to an upper level thereof. The air bubbles move along the oblique surface when coming into contact with the oblique surface, and move to the through opening-side, where the bubbles are discharged to an outer-side of the case. As a result, the air bubbles in the resin filler are efficiently discharged, without obstruction of the cover member. Furthermore, formation of a void, that is a gap of the resin filler, is suppressed.

The cover member preferably has a bottom lowered portion which is formed to project towards the lower part of the case inside. In this case, by having the bottom lowered portion disposed inside the case, a space inside the case is reduced. The filling quantity of the resin filler inside the case can also be reduced as a result.

The cover member preferably has a recessed groove portion, recessed towards the lower part of an upper end surface. In this case, by forming the recessed groove portion, the resin filler leakage from the through opening can be safely accumulated on the cover member. Additionally, the adhesion of foreign substances is preventable. As a result, at a point of installing the ignition coil in an internal combustion engine, occurring defects can therefore be prevented.

The case is provided with a ventilation passage to communicate between an inner portion of a plug tube, which accommodates the spark plug of an internal combustion engine, and an outer portion of the internal combustion engine. The cover member preferably has a cover section which covers an upper side of a discharge port, opened to the outer -side of the internal combustion engine, of the ventilation passage. The ventilation passage has a purpose of easing a change in pressure caused by air expansion and contraction, which is a result of a temperature change of the plug tube, and also to dispose of gas flow.

In such a case, since the cover member has the cover section, a water resistant structure of the ventilation passage of the ignition coil can be omitted. The number of parts of the ignition coil is thus decreased and the productivity can also be increased as a result.

(First Embodiment)

The ignition coil according to a first embodiment is described with reference to FIG. 1 to FIG. 4.

Figure 1:
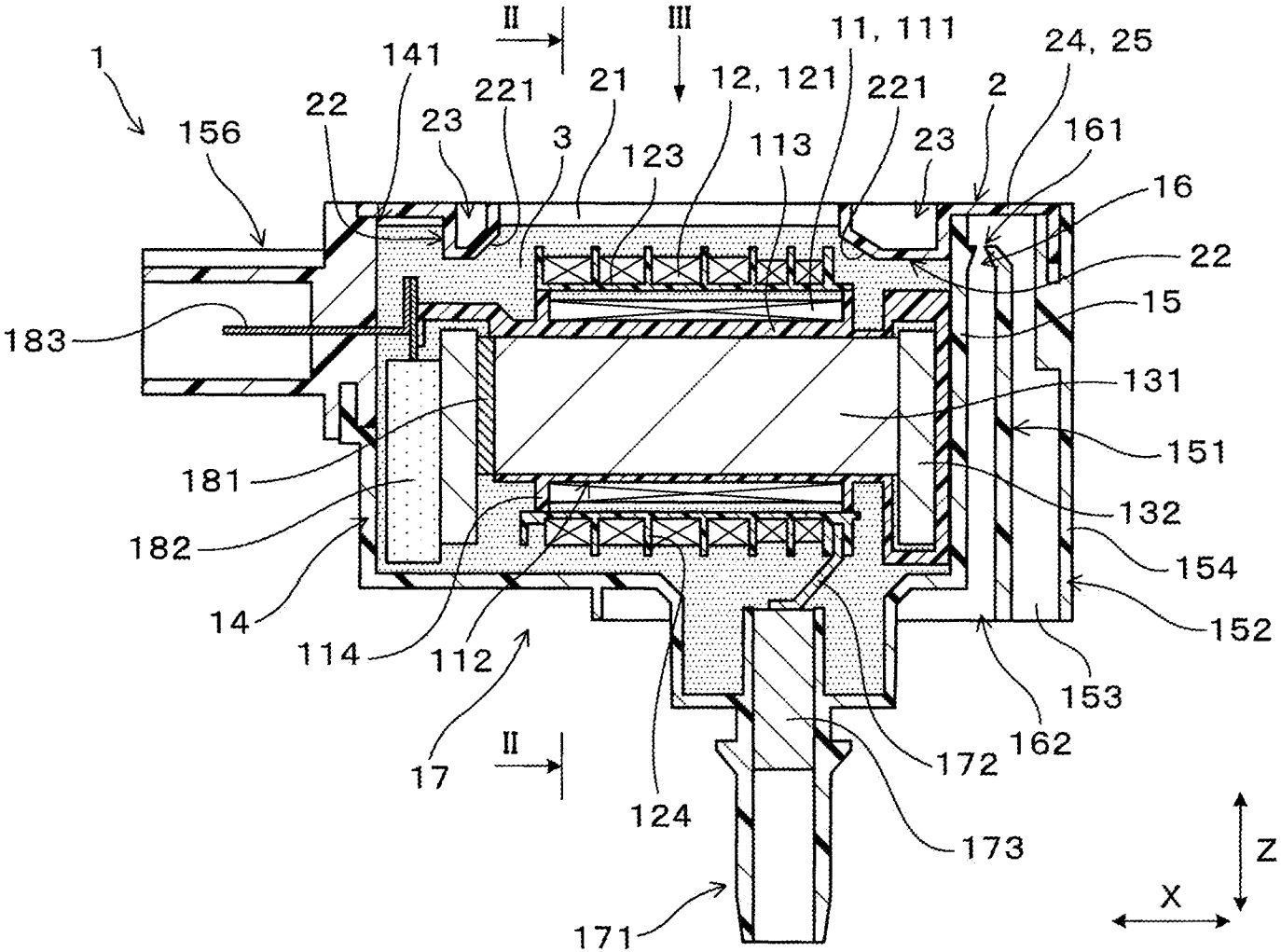
FIG. 1 is a cross sectional diagram showing an ignition coil according to a first embodiment.
Figure 2:
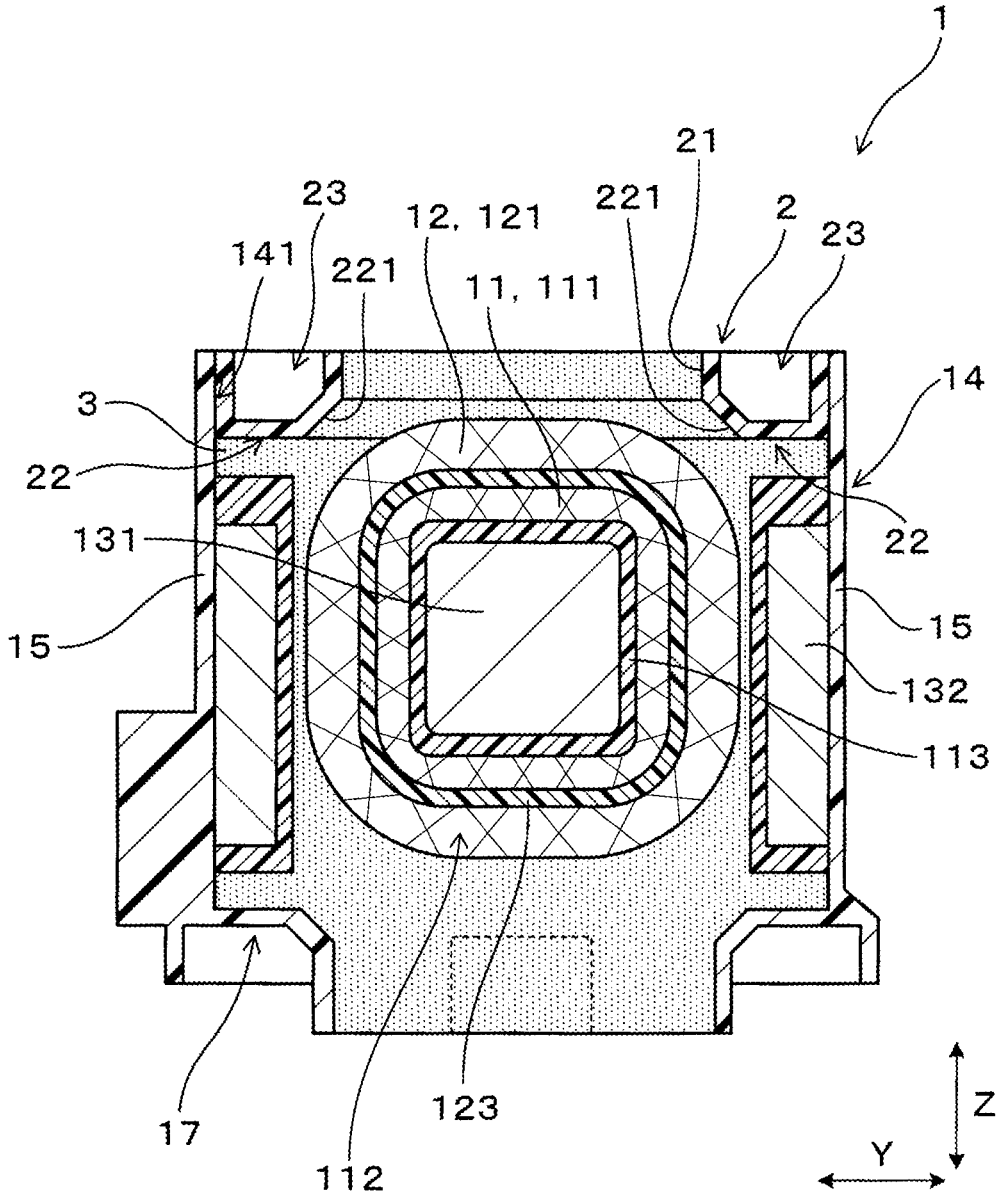
FIG. 2 is a cross sectional diagram of an arrow II-II shown in FIG. 1.

As shown in FIG. 1 and FIG. 2, the ignition coil 1 is provided with a primary coil 11 formed by a primary winding 111, a secondary coil 12 formed by a secondary winding 121 positioned on an outer peripheral side of the primary winding 111, a center core 131 inserted at an inner-side of the primary coil 11 and secondary coil 12, an outer core 132 positioned on an outer side of the primary coil 11 and the secondary coil 12. The primary coil 11, secondary coil 12, the center core 131 and the outer core 132, are accommodated in a case 14. An inside of the case is provided with resin filler having electrical insulating properties.

The case 14 also has an opening member 141 open to an upper-side of a vertical direction, and a side-wall member 15 surrounding the center core 131 and the outer core 132, which also forms the opening member 141. The side-wall member 15 is provided with a bottom member 17 covering a lower side of the side-wall member 15.

The opening member 141, projected from an inner periphery of the opening member 141 towards an inner-side of the case 14, also has a circular cover member 2 provided with a through opening 21 passing through an inner-side of the opening member 141 in the vertical direction.

The first embodiment is described in detail below.

As shown in FIG. 1 and FIG. 2, in the first embodiment, an opening direction of the opening member 141 in the vertical direction is defined as Z, and an inserted direction of the center core 131 positioned at the inner-side of the primary coil 11 is defined as an axial direction X. A horizontal direction Y is defined as being orthogonal to both the vertical direction Z and the axial direction X. Additionally, the opening member 141-side of the side wall member 15 is described as an upper-part and an opposing side described as a lower-part.

In FIG. 1 and FIG. 2, the ignition coil 1 is used in a spark plug mounted in a combustion chamber with an electrode exposed, for applying high voltage in an internal combustion engine of an automatic vehicle. The ignition coil 1 is configured to induce a high voltage in the secondary coil 12, as a result of a voltage change of the primary coil 11.

The primary coil 11 of the ignition coil 1 is formed by winding the primary winding 111 around an outer periphery of a primary spool 112.

The primary spool 112 is formed from an insulating resin and provided with a cylindrically formed main body member 113. The main body 113 includes a pair of rim members 114 disposed from both ends thereof, directed towards an outer peripheral side. A cylindrical primary coil 11 is formed by winding the primary winding 111 there between the pair of rim members 114 of the primary spool 112.

The secondary coil 12 is formed by winding the secondary winding 121 around the secondary spool 122. The secondary spool 122 is on a same axis as the primary spool 112, and arranged on an outer peripheral side of the primary spool 112. The secondary spool 122 is also provided with a main body member 123. The main body 123 includes a plurality of rim members 124 disposed from an outer surface thereof, directed towards an outer peripheral side. The plurality of rims 124 are arranged at equal intervals in the axial direction X, of the main body 123. The secondary coil 12 is formed by winding the secondary winding 121 between adjacent rims 124.

The center core 131 provided at inner-side of the primary spool 112. The center core 131 forms a substantially square column shape of a plurality of steel plates laminated in the vertical Z direction. The center 131 is disposed, so that the longitudinal direction thereof is a same direction as the axial direction X of the primary spool 112.

The outer core 132 is provided on an outer side of the secondary spool 122. The outer peripheral core 132 is provided with a laminate of a plurality of steel plates laminated by a pressing process, and a cover layer made from the insulating resin covering an outer periphery of the laminate. The outer core 132 has an outer shape of a substantially rectangular shape, viewed from above, and also a circular shape through the vertical direction thereof. The primary coil 11, the secondary coil 12 and the center core 131 are arranged at an inner-side of the outer core 132. The outer core 132 surrounds the horizontal direction and the axial direction of the primary coil 11, the secondary coil 12 and the center core 131. Additionally, between one side wall member 15 and an end of the center core 131, a magnet 181 is provided to generate a magnetic path from a magnetic flux which is generated at the primary coil 11 and a magnetic flux of an opposing direction.

As shown in FIG. 1 to FIG. 4, the case 14 surrounds a periphery the primary coil 11, secondary coil 12, center core 131 and outer core 132, and also includes the side wall member 15, which is provided with the opening member 141 at the upper side and the bottom member 17 disposed at a bottom end of the side wall member 15. A connector insertion member 156 is formed in the side wall member 15, along the axial direction X of the center core 131. Also, an igniter 182 electrically connected to a connection terminal 183, is provided at an inner-side of the connector insertion member 156.

A tower member 171 extending towards lower part is formed in the bottom member 17. Additionally, at an inner-side of the tower section 171 a high voltage terminal 173, electrically connected through a high voltage connecting terminal 172, is inserted. The tower section 171 is mounted by a joint that is not shown.

A ventilation passage 16 and a case-side cover section 152 is provided on the side wall member 15-side which is an opposing side of a position of the connector insertion member 156. The ventilation passage 16 is for communicating an inner portion of a plug tube, which accommodates the spark plug of an internal combustion engine, and an outer-side of the internal combustion engine. Furthermore, the ventilation passage 16 has a purpose of easing a change in pressure caused by air expansion and contraction, which is a result of a temperature change of the plug tube, and also to dispose the gas flow gas.

The ventilation passage 16 is formed to pass through in a vertical direction of projection member 151, which is formed as a straight line formation extending in the vertical direction of a surface of the side wall member 15. A flow of air inside the plug tube and a gas flow generated in the internal combustion engine, flows from an introduction port 162, disposed at a lower side of the ventilation pathway 16, to an inside of the ventilation pathway 16. The gas flow is discharged from the case-side cover section 152, via a discharge port 161, which is disposed at an upper side of the ventilation pathway 16.

Figure 3:
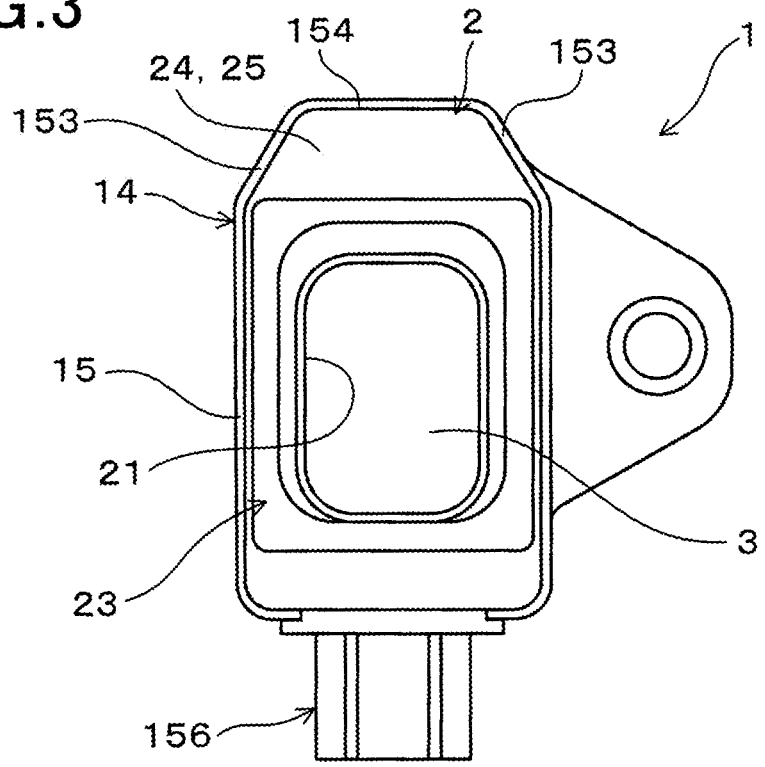
FIG. 3 is diagram of an arrow III shown in FIG. 1.
Figure 4:
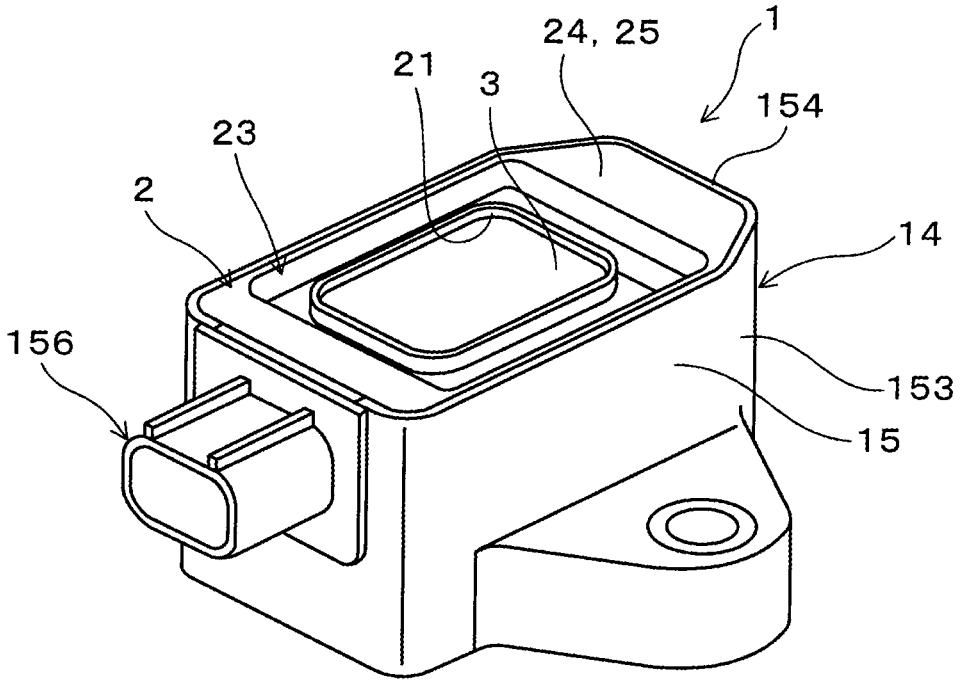
FIG. 4 is an overview of the ignition coil according to the first embodiment.

As shown in FIG. 3, the case side cover section 152 is provided with a pair of stand members 153, disposed on both ends of a width direction of the side wall section 15 formed by the ventilation pathway 16, and a connection member 154 connecting each end of the stand member 153. The case side cover section 152 covers a periphery of the ventilation path 16 through the vertical direction.

As shown in FIG. 1 to FIG. 4, the cover member 2 disposed on the opening member 141 of the case 14, is formed to have an outer rectangular shape that is slightly smaller than an inner shape of the case 14, when viewed from above. In a center of the cover member 2, a substantially rectangular through opening 21 is formed in the vertical direction thereof. Additionally, the cover member 2 is formed so that it may be fitted at an inner-side of the opening member 141. Incidentally, the cover member 2 projects from an inner-periphery of the side-wall member 15 towards the inner-side of the case 14.

A bottom lowered portion 22, protruding towards the lower part, is formed on a bottom surface of the cover member 2. The bottom lowered portion 22 is formed in a total circumference, along an inner periphery of the opening member 141. An oblique surface 221 is formed on the bottom surface of the bottom lowered portion 22. The oblique surface 221 is formed to incline downwards towards the lower part, as the oblique surface 221 advances from an inner-side of the cover member 2 towards an outer side thereof.

A recessed groove portion 23 is formed on a surface of the cover member 2, in which the recessed groove portion 23 recesses towards a lower part thereof. An inner form of the recessed groove portion 23 is a substantially similar shape to an outer form of the cover member 2. The cover member 2 is provided with a cover-side cover section 25, covering an opening of an upper-side of the case-side cover section 152. In providing the cover-side covering section 25 and the case-side covering section 152, an upper-side of the discharge port 161 of the ventilation pathway 16 is covered, therefore, penetration of, for example, water into the discharge port 161 can be prevented.

The case 14 which accommodates, configuring elements, for example, the primary coil 11, the secondary coil 12, the center core 131, the outer core 132 and the cover member 2, is also filled with a resin filler 3 having electric insulating properties of an epoxy resin as a thermosetting resin. The resin filler 3 positions the configuring elements in the case 14, in addition to filling the inside of the case 14 from the through opening 21 of the cover member 2 under vacuum. After the resin filler 3 is filled inside the case 13, the resin filler 3 is solidified by heating using a heating process. Also, the ignition coil 1 is fixed inside the case 14 with the configuring elements in an insulated state.

The working effects of the first embodiment are described.

According to the ignition coil 1, in providing the cover member 2, an opening of the case 14 is decreased. Additionally, an exposed area of a fluid surface, which is the fluid surface of the resin filler 3 before solidification is decreased. As a result, leakage of the fluid resin filler 3, from inside the case 14 can be prevented.

That is, if the exposed surface of the fluid surface of the resin filler 3 is large, a wave height easily increases, when surge waves are generated on the liquid surface, by an external force such as a vibration, and the resin filler 3 easily leaks. In providing the ignition coil 1 with the cover member 2, an open area of the through opening is the exposed area of the fluid surface of the resin filler 3, which is smaller than the opening member 141 of the case 14. As a result, the wave height of the fluid surface can be decreased. Also, since the ignition coil 1 is equipped with the cover 2 surrounding a periphery of the fluid surface of the resin filler, and the side wall member of the case set to a minimum height, leakage of the resin filler can be suppressed.

Furthermore, by providing the cover member 2, a distance between an outer periphery of the case 14 and the through opening 21 is increased. As a result, even if the resin filler 3 leaks from the through opening 21, the resin filler is accumulated in an upper surface of the cover member 2. The ignition coil 1 can also prevent an adhesion of foreign substances, due to the resin filler 3 leakage to an outer side of the ignition coil 1. At a point of installing the ignition coil 1 in an internal combustion engine, defects occurring can therefore be prevented.

As described above, by employing a configuration which can suppress a leakage of the resin filler 3, management of a quantity of resin 3 used when filling the resin filler 3, and each process, that is, from filling the resin filler to transfer during solidification, can be easily performed, and productivity can be easily increased.

At least on a section of the bottom surface of the cover member 2, the oblique surface 221 which is oblique towards a lower part, is formed from an inner periphery of the cover member 2 toward an outer side thereof. In a process of filing the resin filler 3 in the case 14, at a part that is lower than the cover member 2, referred to as "a lower part", air bubbles inside the resin filler 3 float upwards to an upper level thereof. The air bubbles move along the oblique surface 221 when coming into contact with the oblique surface 221. The air bubbles move to the through opening 21-side, and are discharged to an outer-side of the case 14. The air bubbles in the resin filler are thus efficiently discharged, without obstruction of the cover member 2. As a result, formation of a void that is a gap of the resin filler, is suppressed.

The cover member 2 is provided with the bottom lowered portion 22, which is formed to project towards the lower part of the inside of the case 14. As a result, by having the bottom lowered portion 22 disposed inside the case 14, a space inside the case 14 is reduced.

The cover member 2 includes a recessed groove portion 23, recessed towards the lower part of an upper end surface. In this case, by forming the recessed groove portion 23, the resin filler leakage from the through opening can be securely accumulated on the cover member 2. Additionally, the adhesion of foreign substances is preventable. As a result, at a point of installing the ignition coil 1 in an internal combustion engine, defects occurring can thus be prevented.

The case 14 is provided with the ventilation passage 16 to communicate an inner portion of a plug tube, which accommodates the spark plug of the internal combustion engine, and an outer portion of the internal combustion engine. The cover member 2 includes the cover section 24 which covers the upper side of the discharge port 161. Incidentally, the discharge port 161 is open to the outer-side of the internal combustion engine, of the ventilation passage 16. Since the cover member 2 has the covering section 24, configuration of the ignition coil 1 can be simplified. As a result, a number of parts of the ignition coil is decreased and the productivity can be increased.

As described above, the ignition coil 1 according to the first embodiment can suppress leakage of the resin filler before solidification, increase productivity and actualize miniaturization of ignition coil.

(The Second Embodiment)

Figure 5:
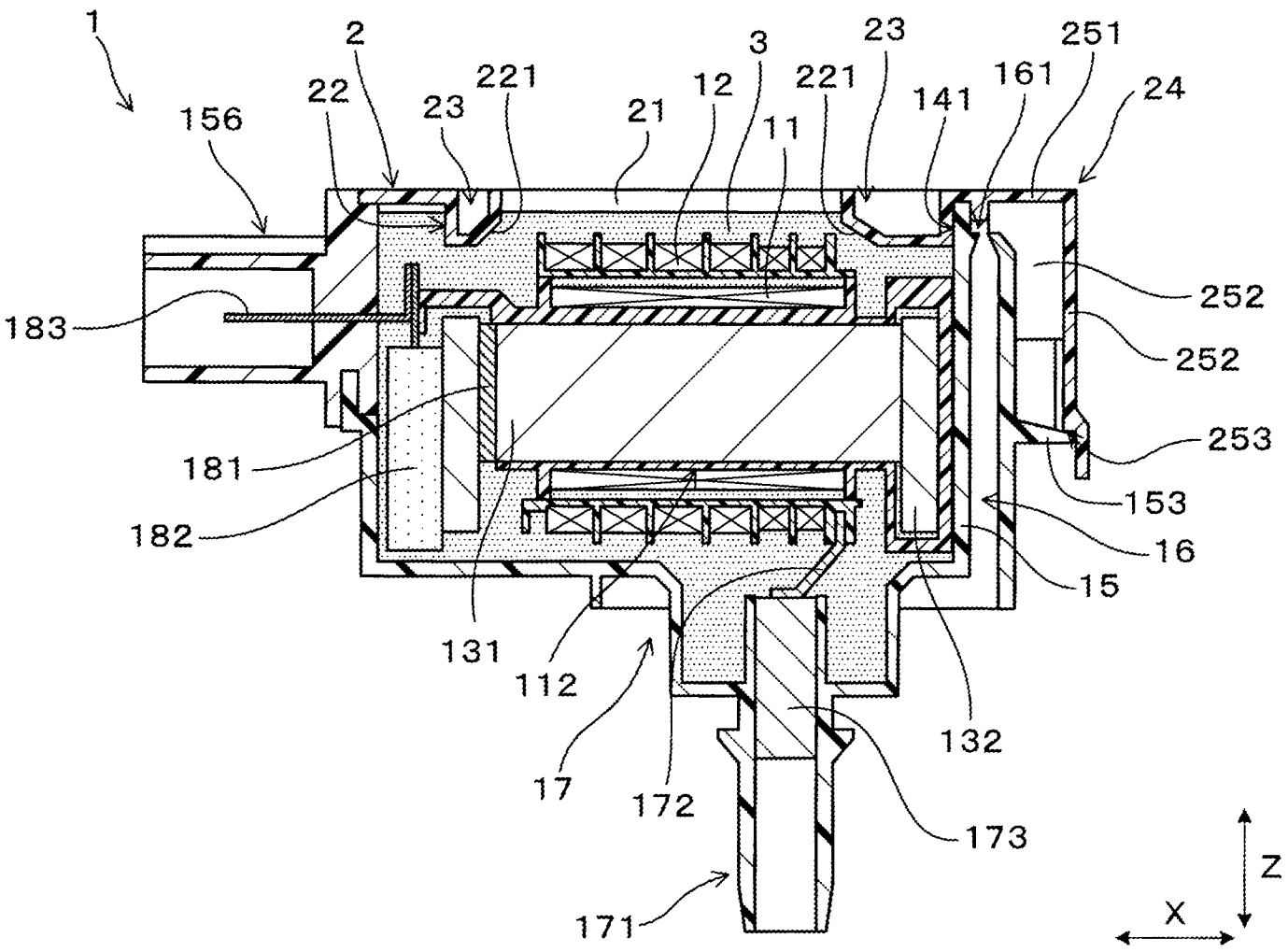
FIG. 5 is a descriptive illustration of an ignition coil according to a second embodiment.

As shown in FIG. 5, the ignition coil according to the second embodiment is an exemplified configuration of the ignition coil according to the first embodiment with parts changed.

The ignition coil 1 in the second embodiment includes, the cover section 24, covering the ventilation pathway 16 in the case 14, formed together with the cover member 2 as one part.

The cover section 24 formed as one part with the cover member 2, is provided with a top surface disposed on an upper part of the discharge port 161 of the ventilation pathway 16 and a side surface section 252 extending from a periphery of the side surface section 251 towards the down part thereof, which also covers a periphery of the upper-side of the ventilation pathway 16. On the side surface section 252, a cover engaging part 155 standing from the side wall section 15 formed by the ventilation pathway 16, and an engaging part 253 which can engage are formed. The other structural aspects are the same as the first embodiment. It is noted that, symbols used in the Figures of an exemplary embodiment or the second embodiment represent a same configuring element as the first embodiment unless stated otherwise.

In the ignition coil in the second embodiment, since the cover section 24 is formed as one part together with the cover member 2, formation of the case 14 of which may become complicated is simplified, and productivity can be enhanced.

Also, a same working effect as the first embodiment can be obtained in the second embodiment.

REFERENCE SIGN LIST

1 Ignition coil, 11 primary coil, 111 primary winding, 12 secondary coil, 121 secondary winding, 131 center core, 132 outer core, 14 case, 141 opening member, 15 side-wall member, 2 cover member, 21 through opening, 3 resin filler.

What is claimed is:

1. An ignition coil for an internal combustion engine, comprising:

a center core having an axial direction and an outer circumferential surface in a radial direction;

a primary coil formed by a primary winding and wound around the outer circumferential surface in the radial direction;

a secondary coil formed by a secondary winding and wound around the primary coil in the radial direction;

an outer core positioned on an outer peripheral side of the primary coil and the secondary coil;

a bottomed case having an inside space and accommodating the primary coil, the secondary coil, the center core and the outer core in the inside space, the case having an opening portion opened from the inside space to an outside space of the ignition coil;

a cover member arranged to close the opening portion of the case, and a resin filler having electrical insulating properties and being filled inside the case such that the center core, the primary and secondary coils, and the outer core are embedded in the resin filler, the cover member having an outer surface exposed to an outside of the ignition coil and an inner surface opposed to the filled resin filler inside the case;

wherein:

the cover member is formed to have a through-hole communicating between the inside and outside of the ignition coil;

a first wall portion forming the through-hole, the first wall portion being raised toward the outside of the ignition coil;

a second wall portion also raised toward the outside of the ignition coil, and a groove portion formed between both the first and second wall portions, the groove portion being located immediately adjacent to the through-hole on the outer surface.

2. The ignition coil for an internal combustion engine according to claim 1, wherein the cover member has, on the inner surface, a bottom lowered portion which protrudes downwardly toward the inside of the case, in relation to the cover member.

3. The ignition coil for an internal combustion engine according to claim 2 wherein the groove portion is recessed downwardly towards the inside of the case, in relation to the cover member.

4. The ignition coil for an internal combustion engine according to claim 2, wherein the case has a ventilation pathway to communicate between an inner portion of a plug tube and an outer portion of the internal combustion engine;

the plug tube accommodates a spark plug of the internal combustion engine, and the cover member comprises a cover section which covers, on the ventilation pathway, an upper part of a discharge port, which is open to an outer-side of the internal combustion engine.

5. The ignition coil for an internal combustion engine according to claim 2, wherein the through-hole communicating through the cover member is unfilled with the resin filler.

6. The ignition coil for an internal combustion engine according to claim 1, wherein the groove portion is recessed downwardly towards the inside of the case, in relation to the cover member.

7. The ignition coil for an internal combustion engine according to claim 6, wherein the cover member has, on the inner surface, a bottom lowered portion which protrudes downwardly toward the inside of the case, in relation to the cover member.

8. The ignition coil for an internal combustion engine according to claim 6, wherein the groove portion is recessed downwardly towards the inside of the case, in relation to the cover member.

9. The ignition coil for an internal combustion engine according to claim 6, wherein the case has a ventilation pathway to communicate between an inner portion of a plug tube and an outer portion of the internal combustion engine, the plug tube accommodates the spark plug of an internal combustion engine, and the cover member comprises a cover section which covers, on the ventilation pathway, an upper part of a discharge port, which is open to an outer-side of the internal combustion engine.

10. The ignition coil for an internal combustion engine according to claim 1, wherein the case has a ventilation pathway to communicate between an inner portion of a plug tube and an outer portion of the internal combustion engine;

the plug tube accommodates a spark plug of the internal combustion engine, and the cover member comprises a cover section which covers, on the ventilation pathway, an upper-side of a discharge port, which is open to an outer-side of the internal combustion engine.

11. The ignition coil for an internal combustion engine according to claim 1, wherein the resin filler has an upper surface, and the cover member is configured to cover the opening portion of the case, such that a part of the upper surface of the resin is exposed via the through-hole.

12. The ignition coil for an internal combustion engine according to claim 1, wherein the through-hole communicating through the cover member is unfilled with the resin filler.

13. The ignition coil for an internal combustion engine according to claim 1, wherein the case has a side wall member surrounding the primary coil, the secondary coil and the outer core, and forming the opening portion, the side wall member is provided with a bottom portion.

14. The ignition coil for an internal combustion engine according to claim 1, wherein the cover member has a bottom surface provided on the inner surface, the bottom surface having an oblique surface that is immediately continued from the first wall portion and formed to be obliquely inward to the case.

* * * * *